US005256457A

United States Patent [19]

Pantaleo et al.

[11] Patent Number: 5,256,457

[45] Date of Patent: * Oct. 26, 1993

[54] SERVING MAT WITH FLOATING FIGURINES THAT ARE ALIGNABLE WITH GRAPHICS IN THE BASE OF THE SERVING MAT

[76] Inventors: Terese A. Pantaleo, 7854 Redondo La., Orland Park, Ill. 60462; Donald E. Perrin, 255 N. 6th St., Clinton, Iowa 52732

[ * ] Notice: The portion of the term of this patent subsequent to Apr. 14, 2009 has been disclaimed.

[21] Appl. No.: 710,157

[22] Filed: Jun. 4, 1991

[51] Int. Cl.[5] ..... B32B 3/18

[52] U.S. Cl. ..... 428/13; 40/406; 273/457; 428/321.5; 446/267

[58] Field of Search ..... 428/13, 46, 166, 321.5; 446/267; 273/457; D6/613; 40/406

[56] References Cited

U.S. PATENT DOCUMENTS

| | | | |
|---|---|---|---|
| D. 175,089 | 7/1955 | Newmark | 428/13 X |
| D. 175,890 | 10/1955 | Knaebel et al. | D23/229 X |
| 2,140,124 | 12/1938 | Banner et al. | 446/74 |
| 2,315,240 | 3/1943 | Ashenberg et al. | 446/149 X |
| 2,703,087 | 3/1955 | Newmark | 606/235 |
| 2,738,616 | 3/1956 | Windle | 428/13 X |
| 2,988,845 | 6/1961 | MacDougall et al. | 428/13 X |
| 3,377,738 | 4/1968 | Goodrum, Jr. | 446/267 |
| 3,777,310 | 12/1973 | Yang | 428/79 X |
| 3,898,781 | 8/1975 | Facchini | 428/13 X |
| 3,924,852 | 12/1975 | Tamol | 446/135 X |
| 3,983,277 | 9/1976 | Ackerman et al. | 428/13 X |
| 4,359,224 | 11/1982 | Nottingham et al. | 428/166 X |
| 4,362,299 | 12/1982 | Suzuki | 446/267 X |
| 4,507,087 | 3/1985 | Stevenson | 446/267 X |
| 4,608,323 | 8/1986 | Zaborney | 428/13 X |
| 4,631,210 | 12/1986 | McGee et al. | 428/13 |
| 4,657,021 | 4/1987 | Perry et al. | 446/267 X |
| 4,738,888 | 4/1988 | Pantaleo et al. | 428/13 X |
| 4,834,688 | 5/1989 | Jones | 446/28 |
| 5,047,267 | 9/1991 | Pantaleo et al. | 428/321.5 X |
| 5,104,699 | 4/1992 | Pantaleo et al. | 428/13 |

FOREIGN PATENT DOCUMENTS 2321310 8/1975 France .

*Primary Examiner*—Henry F. Epstein
*Attorney, Agent, or Firm*—Wallenstein, Wagner & Hattis, Ltd.

[57] ABSTRACT

A device including a pair of superimposed pliable sheets that are interconnected or sealed along peripheral edges. The device includes an enclosed, liquid-containing inner chamber defined by the sealed peripheral edges and by the pair of superimposed pliable sheets. The liquid is freely movable within the chamber. At least one discrete article is suspended within the liquid, and the article is manipulatable by causing displacement of the liquid medium. Graphics are included on one of the sheets. These graphics correspond in shape to the discrete article, and that discrete article is alignable with these graphics.

2 Claims, 1 Drawing Sheet

SERVING MAT WITH FLOATING FIGURINES THAT ARE ALIGNABLE WITH GRAPHICS IN THE BASE OF THE SERVING MAT

DESCRIPTION

1. Technical Field

This invention relates to a manufactured item and, more particularly, to a serving mat or toy which acts as an amusement device.

2. Background of the Invention

Protective serving mats are typically available in restaurants. Examples of novelty placemats are described in U.S. Pat. No. 4,738,888; U.S. Ser. No. 07/526,102, filed on May, 18, 1990 and now abandoned; and U.S. Ser. No. 07/610,504, filed on Nov. 8, 1990 now Pat. No. 5,104,699. The patent and applications describe additional inventions of the same co-inventors of the invention described in the present application. In addition, the present application is directed to a device which is usable as a toy.

The present invention is a further improvement of the devices described in the above-referenced patent and applications. Other United States patents showing the state of this art include U.S. Pat. Nos. Des. 175,890; 2,140,124; 2,315,240; 2,703,087; 2,738,616; 2,988,845; 3,377,738; 3,777,310; 3,898,781; 3,924,852; 3,983,277; 4,359,224; 4,362,299; 4,507,087; 4,608,323; 4,631,210; and 4,834,688; and French Document No. 2,321,310, issued to Lacroix in Aug. 1975.

SUMMARY OF THE INVENTION

The invention is a device which comprises a pair of superimposed pliable sheets interconnected or sealed along at least their peripheral edges. In one embodiment of the invention, these superimposed pliable sheets may also be interconnected along an inner seam that is formed inwardly of the peripheral edges. In this way, the sealed peripheral edges and the inner seam together form and define an annular chamber between the sealed peripheral edges and the inner seam. In yet another embodiment of the invention, a backing sheet is secured to one of the pliable sheets to prevent sliding of the device when it is placed on a support surface.

When the device includes no inner seam, a sole liquid-filled inner chamber is defined by the sealed peripheral edges and the two superimposed pliable sheets. In either event, the liquid is freely movable within one or both chambers. Suspended in the liquid and movable or manipulatable within the liquid is at least one discrete article. One may move that article by displacement of the liquid medium.

The device further includes graphics on at least one of the superimposed sheets. The graphics may take the form of a cutout which corresponds in shape to the shape of the discrete article. The discrete article is alignable with these graphics.

DETAILED DESCRIPTION OF THE PREFERRED EMBODIMENT

Figure 1:
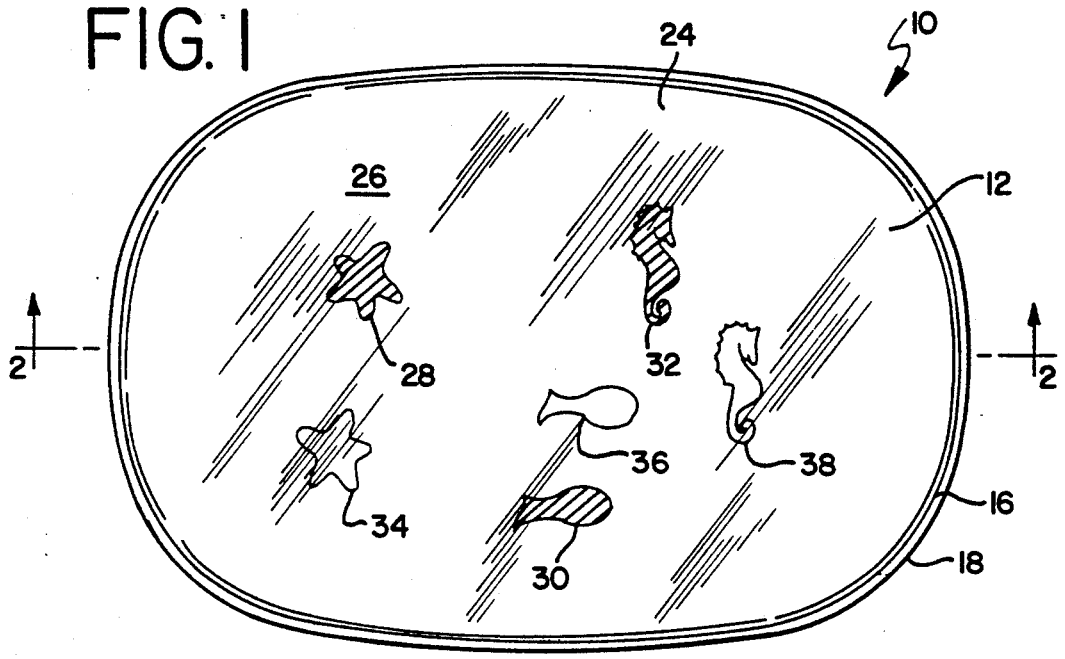
FIG. 1 is a plan view of a device having the features of one embodiment of the present invention.
Figure 2:
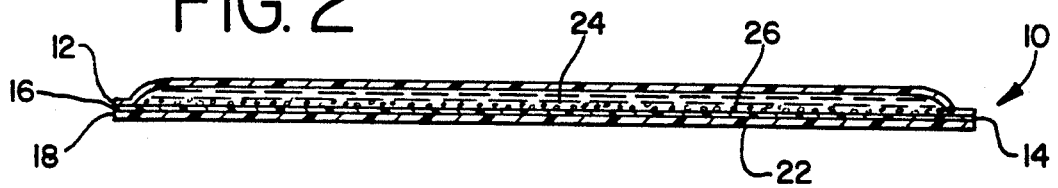
FIG. 2 is a cross-sectional view as viewed along line 2—2 of FIG. 1.
Figure 3:
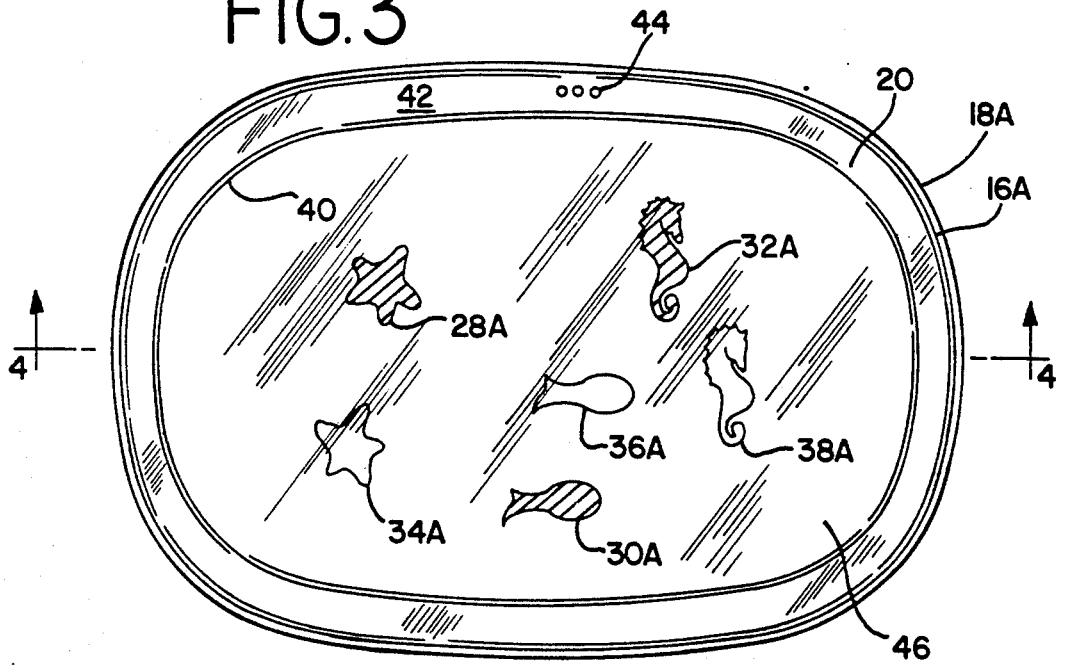
FIG. 3 is a view similar to that of FIG. 1, but showing a slightly modified form of the device.
Figure 4:
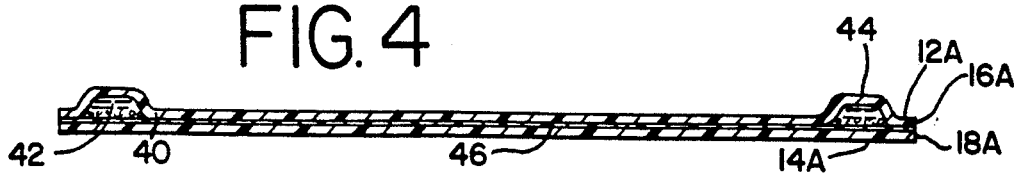
FIG. 4 is cross-sectional view as viewed along line 4—4 of FIG. 3.

The invention is a device of which two embodiments are shown in the figures. The first embodiment is shown in FIGS. 1 and 2, and is a toy 10 which includes a pair of superimposed sheets 12 and 14 which are sealed at their peripheral edges 16 and 18. The second embodiment, which is shown at FIGS. 3 and 4, is like the first embodiment but also includes an inner seam 20.

Referring again to FIGS. 1 and 2, this first embodiment is a toy 10 which comprises a pair of superimposed pliable sheets 12 and 14. In the first embodiment, the first top sheet 12 is made of a clear, pliable plastic, such as polyvinylchloride or polypropylene. The second, lower sheet 14 is made of an opaque, pliable plastic. These two sheets 12 and 14 are interconnected along their respective peripheral edges 16 and 18. Any suitable means of securement for these edges may be used, including heat sealing or adhering with a suitable adhesive. For reasons that will be apparent, any adhesive that is used should be waterproof or liquidproof.

The toy 10 is typically used for amusement by young children at a table or on a floor. Alternatively, the toy 10 may be used as a placemat at a dining room table. In either event, there is little friction between the table and the polyvinylchloride or polypropylene material typically used for the smooth top sheet 12 and smooth lower sheet 14. As a result, a less slippery backing sheet 22 is typically secured to the lower pliable sheet 14 to prevent sliding of the device 10 when it is placed on a table or other support surface. In the preferred embodiment, this backing sheet 22 may also be made of a flexible plastic which has a roughened, non-smooth surface. This roughened surface raises the friction between the toy 10 and the table or support surface upon which it rests. Alternatively, the backing sheet 22 may comprise a sponge backing, which also provides superior gripping force over the polyvinylchloride or polypropylene.

In this first embodiment, an inner chamber 24 is defined by the sealed peripheral edges 16 and 18 and two top 12 and lower 14 superimposed pliable sheets. In either event, the liquid 26 is freely movable within that inner chamber 24. Suspended in the liquid 26, and movable or manipulatable within the liquid 26, is at least one discrete article. In the embodiment of FIGS. 1 and 2, three articles 28, 30 and 32 are shown. The first article 28 is in the shape of a starfish, the second article 30 is in the shape of a fish, and the third article 32 is in the shape of a seahorse.

One may move any of these articles 28, 30 and 32 by displacement of the liquid medium 26 within the inner chamber 24. Displacement of the liquid medium 26 can result from lifting the toy 10 and swirling the liquid 26 within the inner chamber 24. Alternatively, displacement of the liquid medium 26 can result from manipulation of the top 12 or lower 14 pliable sheets. For example, one may use his or her fingers to push down on the top sheet 12, which causes the liquid 26 to move within the inner chamber 24. Articles 28, 30 and 32 then move with this displaced liquid 26.

The device further includes graphics on at least one of the superimposed sheets. In this embodiment, these graphics appear on the lower pliable sheet 14. As may best be seen in FIG. 3, the graphics may take the form of an outline or cutout which corresponds to the shape of the various discrete articles 28, 30 and 32. For example, the general background scenery of the lower pliable sheet 14 comprises an attractive color design. To make the graphics easier to find by young users of the toy 10, the graphics which form an outline or cutout corresponding to the shape of discrete articles 28, 30 and 32 are in black and white. At the left is a black and white graphics outline 34 corresponding to the shape of the starfish 28. In the middle is a black and white graphics outline 36 corresponding to the shape of the fish 30. Finally, at the right is a black and white graphics outline 38 corresponding to the shape of the seahorse 32.

For the amusement of the user, these discrete articles 28, 30 and 32 are alignable with these cutouts or graphics 34, 36 and 38, respectively. Alignment occurs, for example, when the starfish article 28 is floated into registry with the starfish-shaped cutout 34. By applying his or her finger to the starfish article 28, one may retain this starfish 28 in registry with this cutout 34 while the fish 30 and seahorse 32 articles are being aligned.

In the second embodiment of the invention, shown in FIGS. 3 and 4, these superimposed pliable sheets 12A and 14A may also be interconnected along an inner seam 40 that is formed inwardly of the peripheral edges 16A and 18A. In this way, the sealed peripheral edges 16A and 18A and the inner seam 40 cooperatively form and define an annular chamber 42 between the peripheral edges 16A, 18A and the inner seam 40. This annular chamber 42 may also be liquid-filled, and may include additional discrete articles 44 which are movable within that chamber 42. As may be seen in FIG. 4, this annular chamber 42 may be of a circular or oval cross-section. Articles 28A, 30A and 32A are alignable with graphics 34A, 36A and 38A in liquid-filled inner chamber 46.

While the specific embodiments have been illustrated and described, numerous modifications come to mind without markedly departing from the spirit of the invention. The scope of protection is thus only intended to be limited by the scope of the accompanying claims.

What we claim is:

1. A device comprising a pair of superimposed pliable plastic sheets having a continuous seal-forming interconnection therebetween along their respective peripheral edges forming an inner, liquid-filled sealed chamber, one of said sheets constituting a top sheet and being transparent and pliable so as to be pressable toward the other sheet, at least one movable article in said chamber of a thickness less than the spacing between the uncompressed sheets so that said article is suspended for movement in said chamber, said liquid being movable by manipulating the device to cause movement of said movable article in said chamber, the position of said movable article being fixable in position by pressing said pliable top transparent sheet toward the other with the fingers to trap said article between said sheets, and graphics on said other sheet which corresponds in shape and size to said movable article and presents a readily discernible outline corresponding in size and shape to that of said movable article so that the margins of said movable article can be aligned with the margins of said graphics by manipulating said device before said sheet is pressed to trap the article when aligned with said graphics.

2. The device of claim 1 wherein said other sheet presents a colored background about said graphics which are black and white so the graphics stand out from the colored background to facilitate the alignment of said movable article with the margins of the graphics.

* * * * *